US006622623B1

(12) United States Patent
Helmstädter et al.

(10) Patent No.: US 6,622,623 B1
(45) Date of Patent: Sep. 23, 2003

(54) METHOD FOR CONVEYING SHEETS IN A PRINTING MACHINE AND A DEVICE FOR CARRYING OUT THE METHOD

(75) Inventors: Karl-Heinz Helmstädter, Sinsheim (DE); Wolf Kesselhut, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/325,467

(22) Filed: Jun. 3, 1999

(30) Foreign Application Priority Data

Jun. 3, 1998 (DE) ..... 198 24 540

(51) Int. Cl.[7] ..... B41F 13/24

(52) U.S. Cl. ..... 101/232; 271/3.21; 271/33; 226/93

(58) Field of Search ..... 101/232, 177, 101/183; 15/104.002; 271/3.21, 33; 226/93

(56) References Cited

U.S. PATENT DOCUMENTS

| | | | | | |
|---|---|---|---|---|---|
| 3,677,538 | A | * | 7/1972 | Wall | 271/76 |
| 3,809,009 | A | * | 5/1974 | Gerard | 118/44 |
| 4,138,933 | A | * | 2/1979 | Helm | 93/61 |
| 5,019,871 | A | | 5/1991 | Takeda et al. | 355/309 |
| 5,042,383 | A | * | 8/1991 | Wirz | 101/420 |
| 5,060,009 | A | * | 10/1991 | Milovanovich | 271/33 X |
| 5,192,066 | A | * | 3/1993 | Steinhilber | 271/9 |
| 5,345,863 | A | * | 9/1994 | Kurata et al. | 101/126 |
| 5,440,981 | A | * | 8/1995 | Verotacoe et al. | 101/217 |
| 5,540,809 | A | * | 7/1996 | Ida et al. | 156/584 |
| 5,598,779 | A | * | 2/1997 | Haas et al. | 101/230 |
| 5,640,908 | A | * | 6/1997 | Schaede | 101/484 |
| 5,651,310 | A | * | 7/1997 | Kempen | 101/126 |
| 5,727,466 | A | * | 3/1998 | Greive et al. | 101/232 |
| 5,778,783 | A | * | 7/1998 | Compera et al. | 101/232 |
| 5,816,155 | A | * | 10/1998 | Stephan | 101/232 |
| 5,839,366 | A | * | 11/1998 | Schaede | 101/232 |
| 5,862,757 | A | * | 1/1999 | Hauck | 101/484 |
| 5,909,708 | A | * | 6/1999 | BolzaSchunemann | 101/232 X |
| 5,970,866 | A | * | 10/1999 | Okawa | 101/232 X |
| 5,986,683 | A | * | 11/1999 | Sawano et al. | 347/171 |

FOREIGN PATENT DOCUMENTS

| | | |
|---|---|---|
| DE | 477 161 | 5/1929 |
| DE | 30 44 827 A1 | 7/1982 |
| DE | 33 40 727 C2 | 6/1984 |
| DE | 196 43 106 A1 | 4/1997 |
| EP | 341676 * | 11/1989 |

* cited by examiner

*Primary Examiner*—Andrew H. Hirshfeld
*Assistant Examiner*—Minh Chau
(74) *Attorney, Agent, or Firm*—Laurence A. Greenberg; Werner H. Stemer; Gregory L. Mayback

(57) ABSTRACT

In a method for conveying sheets in a sheet-printing machine, the sheets are held securely in position on a circumferential surface of sheet-guiding cylinders with the aid of an adhesive, which can be detached again a number of times and does not transfer itself onto the sheets, and are conveyed through the printing stations of the printing machine. For transport without using grippers, the sheets are held in an area of their front and rear edges only by the adhesive, and are lifted off the circumferential surface of the impression cylinders with the aid of a sheet-lifting device in order for the front edge to be transferred to a downstream sheet-guiding cylinder. Lifting the sheets off the circumferential surface of the cylinders results in a peel-off effect, by which the adhesive bond can be readily released again. In the same way, it is possible to hold the sheets by grippers in the area of their front edge and to additionally secure them by the adhesive only in the area of their rear edges so that the sheets are prevented from smearing or slipping downward.

15 Claims, 5 Drawing Sheets

METHOD FOR CONVEYING SHEETS IN A PRINTING MACHINE AND A DEVICE FOR CARRYING OUT THE METHOD

BACKGROUND OF THE INVENTION

FIELD OF THE INVENTION

The invention relates to a method for conveying sheets in a printing machine and to a device for carrying out the method.

In sheet-printing machines, which in the following text is understood in a very general sense to be devices for printing material in sheet form. The sheets which are to be printed are removed from a stack of paper and are then fed, via conveying devices, such as conveying suckers, sucker rollers, suction belts or grippers, to one or more successive printing stations, in which monochrome or multi-colored printed images are transferred to the sheets. The finished, printed sheets are then placed on a stack.

In rotary offset sheet-printing machines, the sheets are guided, held by grippers, from printing unit to printing unit alternately via impression cylinders and guide drums downstream of the cylinders, the impression cylinders, together with the associated blanket cylinders of a printing unit, forming the respective printing stations. Due to the high levels of precision required for the gripper devices and the remaining moving parts, the outlay on the device which is needed to produce high-quality multicolored printing in the rotary offset sheet-printing machines described is comparatively high.

Published, Non-Prosecuted German Patent Application DE-A 196 431 06 A1 discloses a printing machine for printing sheets, in which the sheets are conveyed to the individual printing stations on a revolving, electrostatically charged belt. A drawback of conveying sheets with the aid of electrostatic charging is that the electrostatic charges may result in voltage sparkovers, and that the electrostatic holding forces which are exerted on the sheets are comparatively low, so that the charge has to be applied over a large area in order to ensure that the sheets are conveyed in register. A further problem is that the finished, printed sheets stick together after they have been deposited on the stack of sheets, owing to residual electrostatic charges, and have to be separated again in order for them to be processed further.

Furthermore, U.S. Pat. No. 5,019,871 discloses a rotary printing machine in the form of an electro-photographic color copier, in which the toner of the colors black, yellow, cyan and magenta is transferred via a light-sensitive drum onto a sheet-guiding cylinder in the form of a transfer drum, on the circumferential surface of which the sheets which are to be printed are held by electrostatic charging.

SUMMARY OF THE INVENTION

It is accordingly an object of the invention to provide a method for conveying sheets in a printing machine and a device for carrying out the method which overcomes the above-mentioned disadvantages of the prior art methods and devices of this general type, in which the sheets are conveyed in register to the individual printing stations without it being necessary to use complex mechanical moving parts, such as gripper devices, etc.

With the foregoing and other objects in view there is provided, in accordance with the invention, a method for guiding sheets in a sheet-printing machine, which includes conveying sheets to printing stations in register with sheet-conveying devices, the sheets being joined to the sheet-conveying devices in a secure position by way of an adhesive.

A further object of the present invention is to provide a printing machine for carrying out the above-mentioned method, in which machine the sheets which are to be printed are guided in register with a high level of precision and at least partly without using mechanical holding devices or with assistance provided to the mechanical holding devices.

Other features which are considered as characteristic for the invention are set forth in the appended claims.

Although the invention is illustrated and described herein as embodied in a method for conveying sheets in a printing machine and a device for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
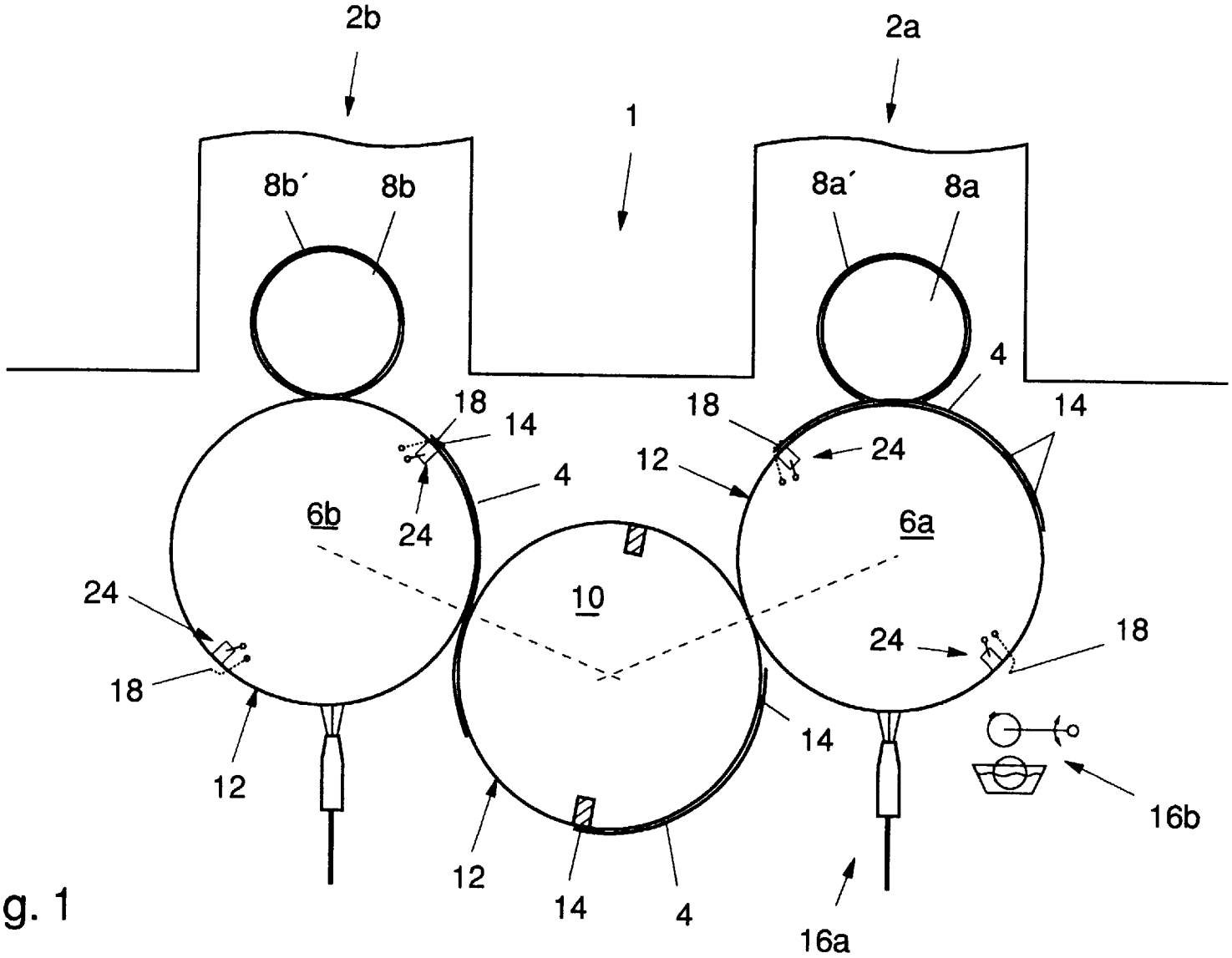
FIG. 1 is diagrammatic, side-elevational view of a rotary sheet-printing machine in which sheets are conveyed from printing station to printing station on a circumferential surface of cylinders with the aid of a film of adhesive which can be detached again according to the invention.

In all the figures of the drawing, sub-features and integral parts that correspond to one another bear the same reference symbol in each case. Referring now to the figures of the drawings in detail and first, particularly, to FIG. 1 thereof, there is shown a rotary sheet-printing machine 1 which contains one or more printing units 2*a*, 2*b*, which form printing stations in which a sheet 4 to be printed is printed in a known way with a colored printed image. In the rotary sheet-printing machine 1 shown in FIG. 1, the printing stations 2*a*, 2*b* are formed by an impression cylinder 6*a*, 6*b* and an ink-transfer cylinder 8*a*, 8*b* which is assigned to the respective impression cylinder 6*a*, 6*b*. The ink-transfer cylinder 8*a*, 8*b* of the printing stations 2*a*, 2*b* may, for example in the case where the rotary sheet-printing machine 1 according to the invention is configured as an offset printing machine, be formed in a known way by a blanket cylinder which transfers the colored printed image of a non-illustrated offset printing form to a top side of the sheet 4 which is to be printed. However, the ink-transfer cylinders 8*a*, 8*b* may in the same way be the flexographic printing cylinders of a known flexographic printing unit, or may equally well be known engraved cylinders which have a multiplicity of small wells in their surface which transfer printing ink directly to the sheets 4 which are to be printed.

In the preferred embodiment of the rotary sheet-printing machine 1, a transfer cylinder 10 is disposed between the impression cylinders 6*a*, 6*b*. The transfer cylinder 10 feeds the sheets 4 which have been printed with a first color in the previous printing unit 2*a* to the second printing unit 2*b* of the printing machine 1.

In order to convey the sheets 4 onto the sheet-conveying devices of the printing machine 1, which in this case are formed by the impression cylinders 6*a*, 6*b* and the transfer cylinder 10, the sheets 4 are held securely in position on a circumferential surface 12 of the cylinders 6*a*, 6*b*, and 10 with the aid of an adhesive 14. The adhesive 14 has been applied to the circumferential surface 12 of the sheet-guiding cylinders 6*a*, 6*b*, 10, in such a way that it is ensured that the sheets 4 are conveyed in register through the printing machine 1 and in the printing stations 2*a*, 2*b*. The adhesive 14 used is preferably an adhesive which can be detached again at any time and can always be stuck back and which is marketed as a prior art product, for example by 3M Deutschland GmbH, 41453 Neuss, Germany, under the name CREATIVE MOUNT as a spray adhesive and which is also used on the yellow adhesive stickers (Post It's) which are used in offices.

As practical tests have shown, the adhesive action of the adhesive 14 falls perceptibly only after several thousand sheets 4 have been printed, so that in this case the adhesive 14 can be reapplied for example with the aid of an adhesive-spraying device 16*a* or a cyclical adhesive-applicator roller 16*b*, as diagrammatically illustrated in the figures.

As indicated in FIG. 1 by gripper devices 18, which are shown in dashed lines, of the impression cylinders 6*a*, 6*b*, the sheets 4 are conveyed on the circumferential surfaces 12 of the sheet-guiding cylinders 6*a*, 10 and 6*b* preferably only by the adhesive 14 which, in order to secure the position of the sheets 4, is preferably applied in an area of sheet front edges, in a form of a strip, possibly a broken strip, to the circumferential surfaces 12 of the cylinders 6*a*, 10 and 6*b*. In the same way, however, it is also possible to provide for the position of the sheets 4 on the circumferential surface 12 of the relevant sheet-guiding cylinders 6*a*, 10 and 6*b* to be secured with the aid of the adhesive 14 in the area of side edges and/or in the area of a rear edge and/or in the area of the entire sheet surface, as diagrammatically indicated in FIG. 1.

According to a further embodiment of the invention, it is in the same way possible for the position of the sheets 4 on the circumferential surface of the impression cylinders 6*a*, 6*b* to be secured merely in such a way as to provide assistance only in the area of a sheet rear edge, a sheet front edge being held in a known way on the impression cylinder 6*a*, 6*b* only by the gripper devices 18. These gripper devices 18 can be provided as mechanical devices or as pneumatic sheet-holding devices. This ensures that the rear edge of the previously printed sheets, after they have passed through the nip formed between the impression cylinder 6*a* and the associated ink-transfer cylinder 8, is not lifted off the circumferential surface 12 of the impression cylinder 6*a* by the effect of centrifugal force, resulting in smearing on the circumferential surface 12 of the transfer cylinder 10, even in the case of heavy printed materials, such as for example cardboard, and high printing speeds. In this case, there may furthermore be provision for the sheet 4 to be guided at its front edge on the impression cylinders 6*a*, 6*b* by the gripper devices 18, as diagrammatically indicated by the dashed lines in FIG. 1, without the use of the adhesive 14, but for the sheets to be conveyed on the transfer cylinder 10 only by the adhesive action of the adhesive 14.

Figure 3:
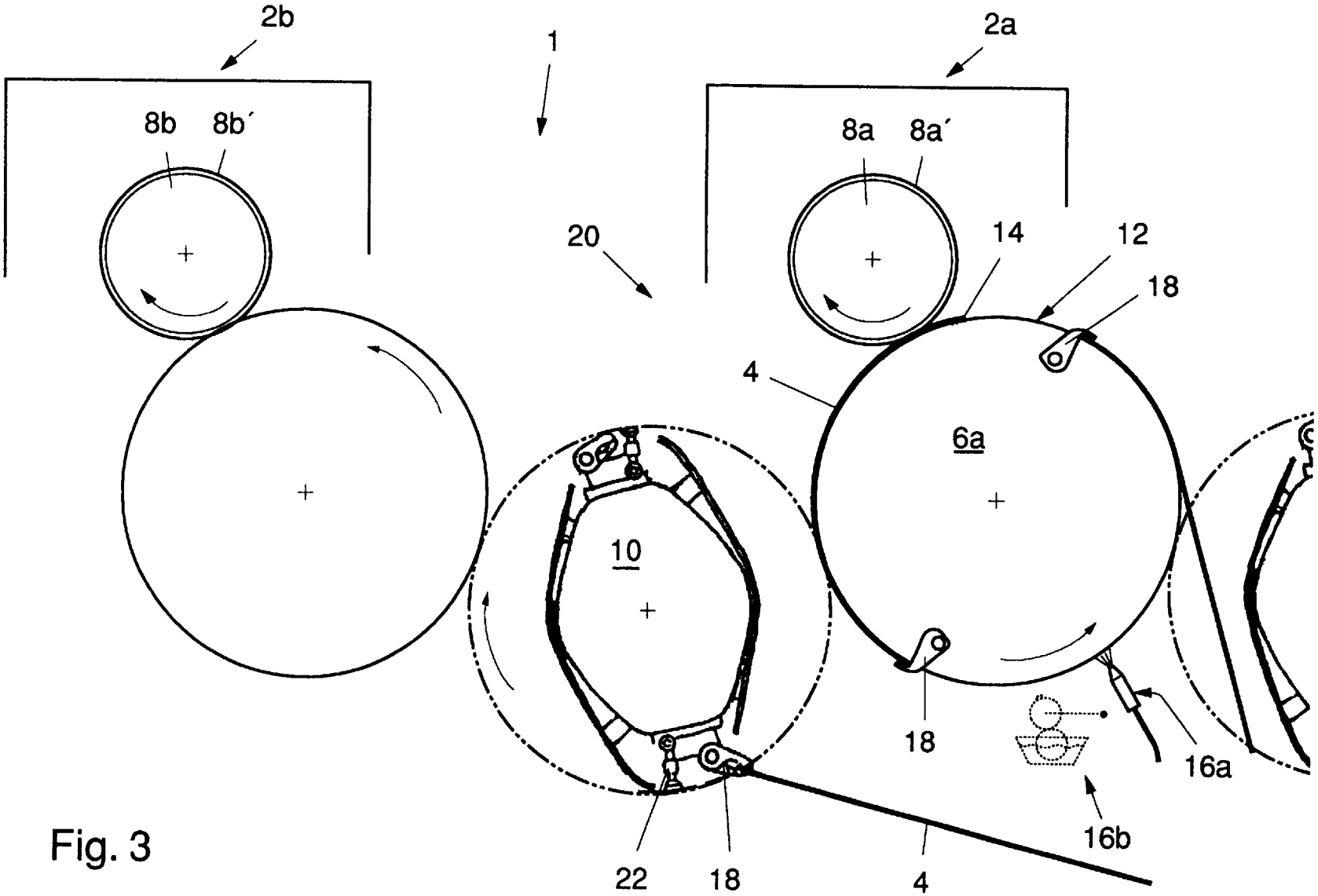
FIG. 3 is a side-elevational view of a turning device for the rotary sheet-printing machine in which device a sheet which has been printed on one side in a previous printing station, having been turned using the principle of sheet rear-edge turning, is transferred to a gripper device of a downstream sheet-guiding cylinder, the sheet being held on the impression cylinder, before a rear edge is transferred with the assistance of the adhesive which can be detached again, in the area of the rear edge.

The above-described conveying of the sheets 4 by the gripper devices 18 in the area of the sheet front edge in combination with the adhesive-assisted securing of the position of the sheets 4 according to the invention in the area of the rear edge, particularly when a known turning device 20 as illustrated in FIG. 3 is used, ensures that the rear edge of the sheets 4 which are to be turned is held in register on the circumferential surface 12 of the impression cylinder 6*a*, which in this case serves as a storage drum, if the rear edge of the sheets 4 is lifted off the circumferential surface 12 of the impression cylinder 6*a* in a known way by a suction gripper 22 and is transferred to a further gripper device 18, for example a pincer gripper, of the transfer cylinder 10. Particularly when the transfer cylinder 10 is configured as a turning drum which is illustrated in FIG. 3, it is ensured that the sheet rear edge is always transferred in register when processing a very wide variety of printed materials.

According to a further embodiment of the invention, there may be provision for sheet-lifting devices 24, in the form of a mechanical sheet-lifting device 24, to be disposed within the periphery of the sheet-guiding cylinders, in particular of the impression cylinders 6*a*, 6*b* (FIG. 1).

Figure 2:
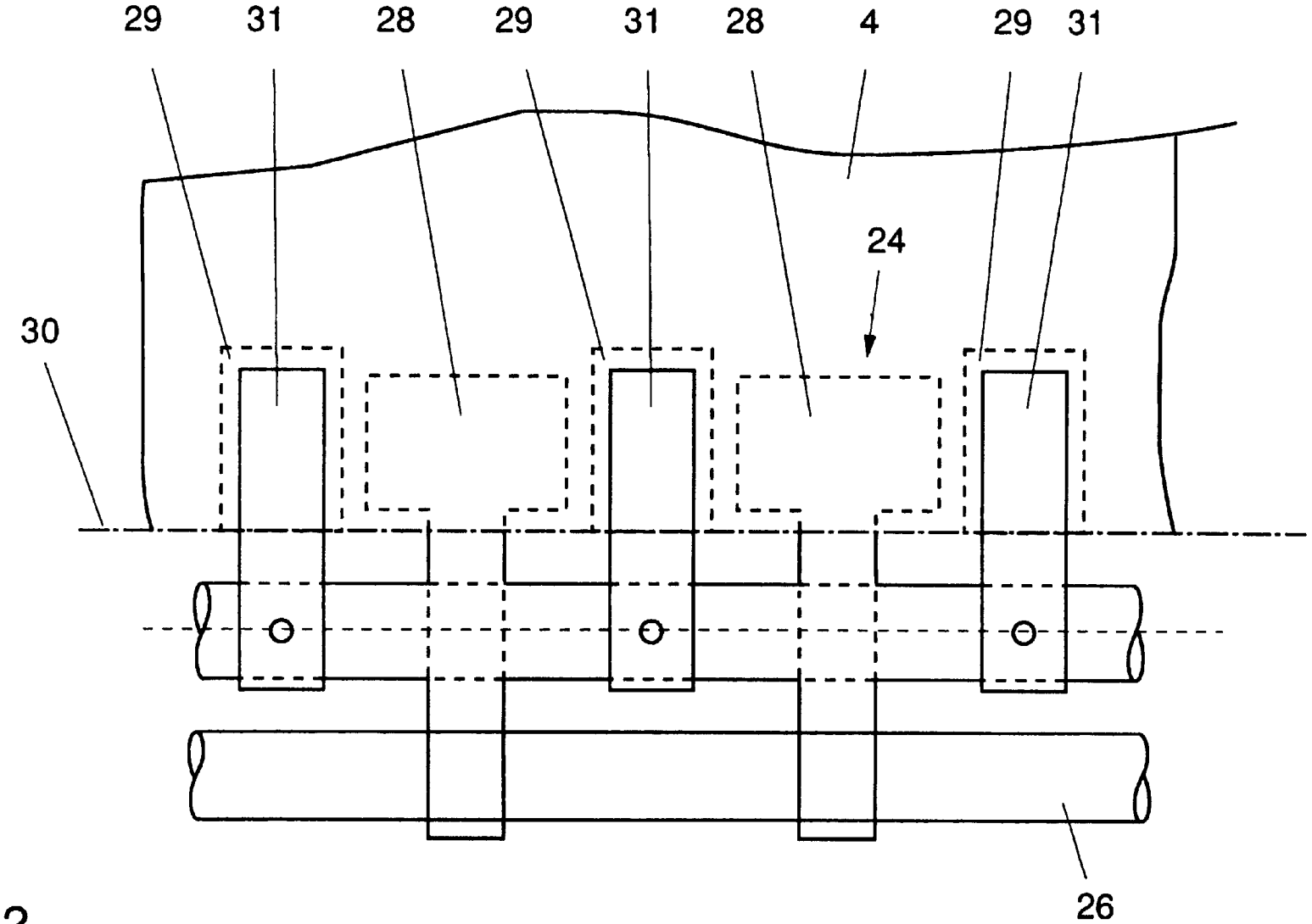
FIG. 2 is a partial, plan view of a sheet-lifting device which is employed in the printing machine which lifts the sheets off the circumferential surface of the sheet-guiding cylinder counter to adhesive forces before they are transferred to a downstream sheet-guiding cylinder.

As illustrated in FIG. 2, the sheet-lifting device 24, may for example, contain a plurality of sheet-lifting elements 28 that are disposed at intervals on a shaft 26 and can be pivoted out of the periphery of the impression cylinder 6*a* in the area of the sheet front edge, which in FIG. 2 is indicated by a dot-dashed line 30.

According to an embodiment in which the sheets 4 are held on the impression cylinders 6*a*, 6*b* of the printing machine 1 in the area of the front edge 30 only by the gripper devices 18 illustrated in dashed lines in FIG. 2 and fixing by the adhesive 14 takes place only in the area of a center of the sheets or in the area of their rear edge, the sheet-lifting elements 28 are used to press the front edge of the sheets 4, when the gripper centers pass between the impression cylinder 6*a* and the downstream transfer cylinder 10, against the circumferential surface 12 of the transfer cylinder 10, which surface is coated with the adhesive 14 in the area of the front edge. The result is that the sheet front edge is transferred in register from the upstream impression cylinder 6*a* to the downstream transfer cylinder 10, the sheets 4 being held securely in position on the transfer cylinder 10 only by the adhesive force of the adhesive 14.

If, as described above, the sheets 4 are conveyed on the impression cylinder 6*a* without the use of grippers and the front edge of the sheets 4 is held on the circumferential surface 12 of the impression cylinder 6*a* only by the adhesive 14, the sheets 4 are peeled off the circumferential surface 12 of the impression cylinder 6*a* as a result of the sheet-lifting elements 28 pivoting out. The peeling action results in the sheet 4 being detached from the circumferential surface 12 of the impression cylinder 6*a*, 6*b* very easily and without there being any risk of the sheet 4 being damaged and in the sheet 4 being pressed against the circumferential surface 12 of the downstream transfer cylinder 10*a* which is likewise coated with the adhesive 14 in the area of the sheet front edge. The circumferential surface 12 of the transfer cylinder 10 is in this case preferably likewise coated with the adhesive 14 in the areas of the sheet front edge in which the sheet-lifting elements 28 press the edge against the circumferential surface 12 of the transfer cylinder 10, whereas there is preferably no adhesive 14 on the sheet-lifting elements 28.

In addition, the sheet 14 can be peeled off the circumferential surface 12 of the impression cylinder 6*a* or of the transfer cylinder 10 without additional measures if the sheets 4 are held securely in position on the circumferential surface 12 with assistance from the adhesive 14 only in the area of its center or in the area of the rear edges, so that in this case too the sheets can readily be detached from the circumferential surface 12 of the relevant cylinder during sheet transfer.

According to a further embodiment of the invention, there may be provision for gripper supports 29 (FIG. 2) and/or gripper fingers 31, which grip the sheet front edge 30, of the gripper device 13 of the sheet-guiding cylinders of the rotary printing machine 1 to be coated with the above-described adhesive 14 which can be detached a number of times. As a result, the sheets 4 can be guided in register through the printing machine 1 even with comparatively low pressure forces between the gripper fingers 31 and the gripper supports 29 and when smooth-surfaced gripper supports 29 which are inexpensive to produce are used, since the tensile forces acting on the sheets 4 are applied by the adhesive 14 and not, as is otherwise customary, by the friction forces between the sheets 4 and the gripper supports 29 or the gripper fingers 31.

Figure 4:
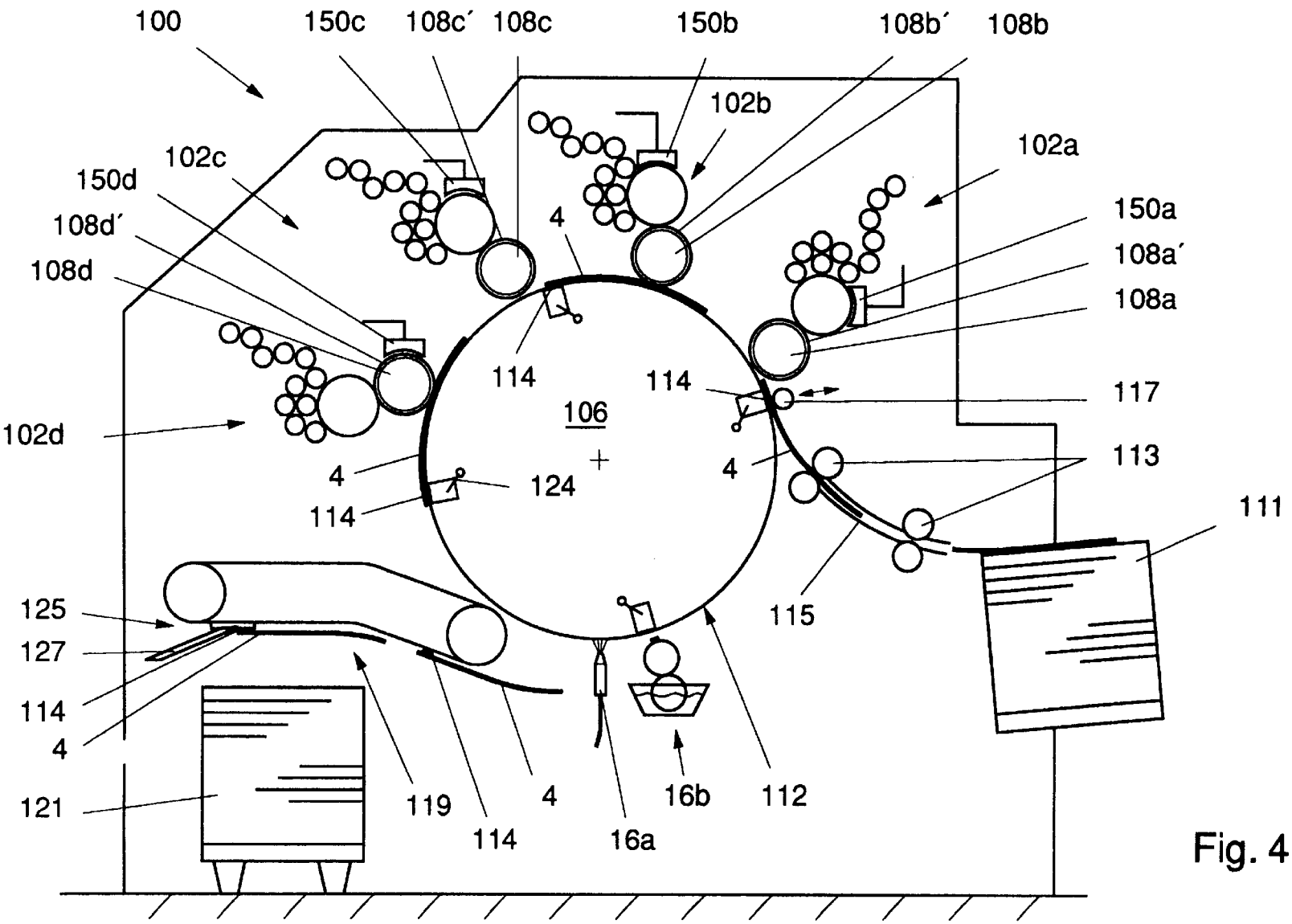
FIG. 4 is a side-elevational view of a satellite printing machine in which the sheets which are to be printed are guided in register on the circumferential surface of a central impression cylinder with the aid of the adhesive which can be detached again and in which ink-transfer cylinders are configured as flying cylinders onto which, depending on the particular printing method employed, ink-transfer sleeves, such as for example offset blanket sleeves, gravure sleeves, flexographic sleeves, etc., can be pushed in an axial direction.

According to a further preferred embodiment of the invention, the principle of the invention is advantageously employed in a satellite printing machine 100 which is illustrated in FIG. 4 and has a central impression cylinder 106 which, together with a plurality of, preferably four, ink-transfer cylinders 108*a*, 108*b*, 108*c* and 108*d*, forms printing stations 102*a*, 102*b*, 102*c* and 102*d*. The sheets 4, which are removed from a stack 111 in a known way, for example by cyclical rolls 113 or suckers (not shown), are conveyed along a conveying path 115, preferably essentially tangentially, in a direction of a circumferential surface 112 of the central impression cylinder 106, and on reaching a predetermined position are pressed against the circumferential surface 112, for example by a pressure roller 117, in the area of the sheet front edge. On the circumferential surface 112, in this area, there is a layer of an adhesive 114 described above, which holds the sheets 4 securely in position on the circumferential surface 112.

According to a further embodiment of the invention, a pressure roller 117 may have additional gripper devices which are not shown in the figures and penetrate into associated comb-like recesses which are formed, for example, in the area of the front edge of the sheets 4, positioning the sheets 4 in register with respect to the circumferential surface 112 of the impression cylinder 106 before the sheets 4 are pressed against the circumferential surface 112 in the area of their front edge by the pressure roller 117.

When the central impression cylinder 106 rotates further, the sheets 4, which are held securely in register on a circumferential surface 112 of the cylinder 106 by the adhesive 114, are successively fed to the printing stations 102*a*, 102*b*, 102*c* and 102*d*, in which they are preferably successively printed with the colors black, yellow, cyan and magenta. After the sheets 4 have left the final printing station 108*d*, they are preferably taken over, in the region of their front edge, by a downstream conveyor system 119, preferably a known chain delivery system 119 which is shown and delivers the sheets 4 in a known way to a delivery stack 121.

The sheets 4 may be transferred to the chain delivery system 119 for example by sheet-lifting devices 124 which may, for example, be configured in the same way as the sheet-lifting devices 24 illustrated in FIG. 2. The sheet-lifting devices 124 lift the sheets 4 off the circumferential surface 112 of the central impression cylinder 106 counter to the adhesive action of the adhesive 114 in the region of their front edge, resulting in a peeling action and therefore allowing the adhesive bond to be detached easily. The chain delivery system 119 which takes over the sheets 4 may in turn, in the area of the front edge of the sheets 4, have surfaces which are coated with the adhesive 114 and against which the front edge of the sheets 4 is pressed by the sheet-lifting devices 124. In the same way, there may be provision for a chain delivery system 119, in a known way, to have gripper bridges, the grippers of which engage in associated groove-like recesses which are formed, in the area of the front edge of the sheets 4, in the circumferential surface 112 of the central impression cylinder 106, e.g. the recess described above. In this embodiment of the invention, it is advantageous, although not absolutely necessary, to use the sheet-lifting devices 124.

As is further shown in FIG. 4, a sheet-peeling device 125 may be disposed above the delivery stack 121. The sheet-peeling device 125, in the most simple case, may be formed by a doctor-like metal plate 127 which acts in the area of the front edge of the conveyed sheets 4 and is illustrated in detail in FIG. 4*a*.

Figure 5:
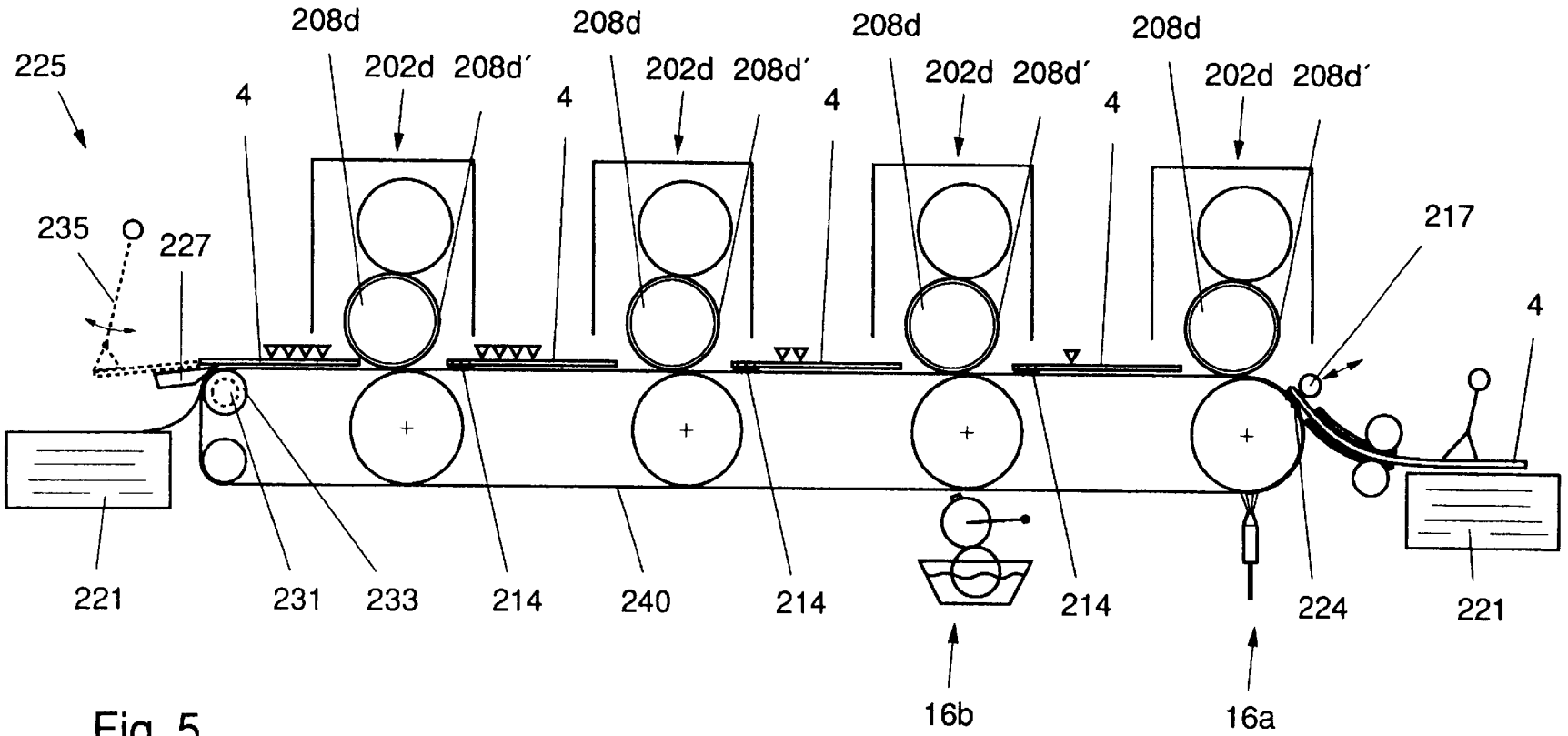
FIG. 5 is a side-elevational view of a further embodiment of the printing machine in which the sheets are fixed in register on a revolving, endless belt with the aid of the adhesive which can be detached again and are conveyed to a plurality of successive printing stations for the various colors.

In accordance with a further embodiment, which is illustrated in FIG. 5, of a sheet-printing machine 200 according to the invention, the sheets are guided through printing stations 202*a*, 202*b*, 202*c* and 202*d* with the aid of an endless conveyor belt 240, in which printing stations they are successively printed, in a known way, with printed images of different colors.

In the same way as that described above in connection with the satellite machine according to the invention shown in FIG. 4, the sheets 4 are removed from a feeder stack 221 and are fed essentially tangentially to the endless conveyor belt 240, and are pressed against the revolving conveyor belt 240, in the area of the sheet front edge, for example by a pressure roller 217, in which area the conveyor belt 240 is coated with an adhesive 214 as described above which can be detached again and holds the sheets 4 securely in position on the revolving belt 240 while they are conveyed through the printing stations 202*a*, 202*b*, 202*c* and 202*d*. After the sheets 4 have been printed on their top side in the final printing unit 202*d*, they can be peeled off the endless belt 240, for example by a peeling device 225 which is illustrated diagrammatically in FIG. 5, and placed on a delivery stack 221. The peeling device 225 may, as illustrated diagrammatically in FIG. 5, be formed, for example, by a peeling doctor 227, which, in the area of a diversion roller 231 of the endless belt 240, for example above a groove 233, may be placed, preferably cyclically, against the surface of the revolving belt 240 and peels the sheets 4 off the revolving belt 240 starting from their front edge.

In the same way, it is possible for the sheets 4 which are held securely in position on the revolving belt 240 by the adhesive 214 to be peeled off with the aid of a known suction gripper 235 which acts on the front edge of the sheets 4 and is diagrammatically illustrated in dashed lines in FIG. 5.

Furthermore, it may be advantageous if the conveyor belt 240 is not coated with the adhesive 214 in the areas of the sheet front edges in which the peeling doctors 227 or the suction gripper 235 act, in order to facilitate the peeling operation.

Although the principle of the invention has been described above in connection with the conveyor belt 240 which runs through the printing stations 202*a* to 202*d*, it may also be applied, for example, to the other endlessly revolving conveyor belts which are employed in rotary printing machines, such as for example the suction belts of a sheet feeder or the conveyor belts in a folding appliance of a web-fed printing machine.

In the embodiments of the sheet-printing machines 1, 100, 200 which are (illustrated in FIGS. 1, 3, 4 and 5, the ink-transfer cylinders 8*a*, 8*b*; 108*a* to 108*d* and 208*a* to 208*d* are preferably configured as flying cylinders which are known from the prior art and support an ink-transfer sleeve 8*a*', 8*b*', 108*a*' to 108*d*' and 208*a*' to 208*d*' which can be pushed onto a base body of the cylinder in an axial direction.

If the sheet-printing machines according to the invention are configured as offset printing machines, the ink-transfer sleeves 8*a*', 8*b*', 108*a*' to 108*d*' and 208*a*' to 208*d*' are formed by known blanket sleeves which support a sleeve-shaped blanket which preferably has a layer whose volume can be compressed. In order for the blanket sleeves to be pushed onto the base bodies of the ink-transfer cylinders, the blanket sleeves are expanded in a known way with the aid of compressed-air nozzles formed in the circumferential surface of the cylinder bodies and are pushed onto the cylinder on the resultant air cushion, and they clamp securely onto the cylinder after the compressed air has been switched off, as described, for example, in U.S. Pat. No. 5,440,981. The use of sleeve-like blankets, in particular in the satellite printing machine 100 according to the invention which is illustrated in FIG. 4, offers the advantage that the blankets can be changed very quickly and, moreover, the machine can be configured in such a way that the plate cylinders are readily accessible in order for the printing plate to be changed. In this case, there may furthermore be provision for the plate cylinders to be digitally illustrated in a known way, e.g. by a digital (laser) illustrating devices 150*a*, 150*b*, 150*c* and 150*d* which are indicated diagrammatically in FIG. 4. The digital (laser) illustrating devices and the associated printing forms are known from the prior art. However, the use of the digital illustrating devices is not limited to the satellite printing machine 100 shown in FIG. 4, but rather may in principle also apply to the other novel sheet-printing machines 1 and 200 depicted.

According to a further embodiment of the invention, there may be provision for the ink-transfer sleeves 8*a*', 8*b*', 108*a*' to 108*d*' and 208*a*' to 208*d*' which can be pushed onto the cylinders 8, 108, 208 in the axial direction to be constructed as flexographic printing sleeves or as engraved cylinders, in which case the printing stations 2*a*, 2*b*, 102*a* to 102*d* and 202*a* to 202*d* are correspondingly configured as flexographic printing units or as gravure printing units.

Finally, it is possible for the printing stations 2*a*, 2*b*, 102*a* to 102*d* and 202*a* to 202*d* to be configured as printing units which operate using a photo-electrographic method, as used, for example, in color copiers. In this embodiment of the invention, the ink-transfer cylinders 8*a*, 8*b*, 108*a* to 108*d* and 208*a* to 208*d* are formed by d rums which transfer liquid or powder toner, such as those which are known from copying machines or laser printers, for example. In the embodiment of the invention too, the sheets 4 are preferably held securely, in position on the circumferential surface of the sheet-guiding cylinders which cooperate with the toner drum or drums only by the adhesive action of the adhesive 14, 114, 214 which can be detached again.

Furthermore, it is possible to use two or more of the above-described printing methods together in a printing machine, in order for it to be possible for the printing machine to be used, for example, as a hybrid printing machine for flexographic printing and offset printing, for gravure printing and offset printing, or for offset printing and electro-photographic printing, etc.

We claim:

1. A method for guiding sheets in a sheet-printing machine, which comprises:

conveying the sheets to printing stations in register by sheet-conveying devices, the sheets being joined to the sheet-conveying devices in a secure position by a layer of a reusable adhesive in at least one area covering less than an entire surface of the sheets;

providing the sheet-conveying devices with a sheet-guiding, rotating cylinder;

applying the layer of the adhesive on the sheet-guiding, rotating cylinder;

holding the sheets on the sheet-guiding, rotating cylinder with the layer of the adhesive; and lifting the sheets off a circumferential surface of the sheet-guiding, rotating cylinder counter to adhesive forces of the layer of the adhesive with a sheet-lifting device disposed within a periphery of the sheet-guiding, rotating cylinder, for transferring the sheets to a downstream sheet-conveying device.

2. The method according to claim 1, which comprises additionally holding the sheets on the circumferential surface of the sheet-guiding, rotating cylinder by mechanical devices.

3. The method according to claim 1, which comprises additionally holding the sheets on the circumferential surface of the sheet-guiding, rotating cylinder by pneumatic sheet-holding devices.

4. The method according to claim 1, which comprises holding the sheets on the sheet-guiding, rotating cylinder only by the layer of the adhesive.

5. The method according to claim 1, which comprises applying the layer of the adhesive to the sheet-conveying devices for securing the sheets in position on the sheet-conveying devices, the layer of the adhesive being detachably applied such that the layer of the adhesive can be removed a number of times from the sheet-conveying devices and does not transfer itself onto the sheets.

6. A printing machine for printing sheets with monochrome or multicolored printed images, comprising:

sheet-conveying devices for conveying the sheets, said sheet-conveying devices including a rotating printing-machine cylinder with a circumferential surface on which the sheets are conveyed in register and a further sheet-conveying device disposed downstream of said rotating printing-machine cylinder;

a layer of a reusable adhesive disposed on at least one of said sheet-conveying devices, said layer of adhesive holding the sheets, in at least one area covering less than an entire surface of the sheets, securely in position on said sheet-conveying devices having said layer of adhesive disposed thereon; and a sheet-lifting device disposed on said rotating printing-machine cylinder and lifting the sheets held securely in position on said circumferential surface of said rotating printing-machine cylinder by said adhesive for transferring the sheets to said further sheet-conveying device.

7. The printing machine according to claim 6, including an ink-transfer cylinder, said rotating printing-machine cylinder is an impression cylinder which, together with said ink-transfer cylinder forms a printing station.

8. The printing machine according to claim 7, wherein said sheet-conveying devices include a sheet-guiding cylinder having gripper devices and a turning device, said impression cylinder is a storage drum of said turning device for transferring a sheet, which has been printed on one side in a previous printing station and having been turned using a principle of sheet rear-edge turning, to said gripper devices of said sheet-guiding cylinder disposed downstream of said turning device, the sheet having a rear edge on said impression cylinder, before the rear edge is transferred, being held on said circumferential surface of said impression cylinder by said adhesive in an area of the rear edge.

9. The printing machine according to claim 7, wherein said ink-transfer cylinder is a blanket cylinder of an offset printing machine.

10. The printing machine according to claims 9, wherein said ink-transfer cylinder is a cylinder mounted in a flying position when the printing machine is at a standstill and onto which an ink-transfer sleeve can be pushed in an axial direction.

11. The printing machine according to claim 7, wherein said ink-transfer cylinder is a toner-transfer drum of a copier.

12. The printing machine according to claim 7, wherein said ink-transfer cylinder is an engraved cylinder of a gravure printing unit.

13. The printing machine according to claim 7, wherein said ink-transfer cylinder is a flexographic cylinder of a flexographic printing unit.

14. The printing machine according to claim 6, further comprising printing stations including a previous printing station and a downstream printing station, said rotating printing-machine cylinder is a transfer cylinder feeding a sheet printed in said previous printing station to said downstream printing station.

15. The printing machine according to claim 6, wherein said sheet-conveying devices include a gripper device having a gripper support and a gripper finger, said adhesive being applied to at least one of said gripper support and said gripper finger of said gripper device.

* * * * *